US007282885B2

(12) United States Patent
Krimmer

(10) Patent No.: US 7,282,885 B2
(45) Date of Patent: Oct. 16, 2007

(54) DEVICE AND METHOD FOR CONTROLLING AN ELECTRIC MOTOR, ESPECIALLY IN MOTOR VEHICLES

(75) Inventor: Stefan Krimmer, Markt Indersdorf (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 11/509,626

(22) Filed: Aug. 25, 2006

(65) Prior Publication Data

US 2007/0029957 A1 Feb. 8, 2007

Related U.S. Application Data

(63) Continuation of application No. PCT/EP2005/001569, filed on Feb. 16, 2005.

(30) Foreign Application Priority Data

Feb. 26, 2004 (DE) ..... 10 2004 009 307

(51) Int. Cl.
*H02P 1/46* (2006.01)

(52) U.S. Cl. ..... 318/701; 139/254; 139/375; 139/599

(58) Field of Classification Search ..... 318/701, 318/139, 254, 375, 369, 362, 638, 445, 446, 318/430, 432, 434, 700, 599, 567, 570
See application file for complete search history.

(56) References Cited

U.S. PATENT DOCUMENTS

2005/0264254 A1* 12/2005 Lequesne et al. ..... 318/701
2006/0042593 A1* 3/2006 Nakamoto et al. ..... 123/399

FOREIGN PATENT DOCUMENTS

| | | |
|---|---|---|
| DE | 40 38 199 A1 | 6/1992 |
| DE | 41 23 706 A1 | 1/1993 |
| DE | 198 11 992 A1 | 9/1999 |
| EP | 0 717 172 A1 | 6/1996 |
| JP | 2003-235291 A | 8/2003 |

OTHER PUBLICATIONS

German Office Action dated Oct. 18, 2006 Including an English translation (six (6) pages.
International Search Report dated Jun. 8, 2005 including English Translation of relevant portion (Four (4) pages).

* cited by examiner

*Primary Examiner*—Karen Masih
(74) *Attorney, Agent, or Firm*—Crowell & Moring LLP

(57) ABSTRACT

In a device for controlling an electric motor, especially in motor vehicles, for setting a setting element, moved by the electric motor, as a function of the deviation of an actual setting from a nominal setting of the setting element, by means of a controller, which contains a microprocessor that carries out a hardware initialization routine at least in one step and a software initialization routine optionally in a second step, once the controller has been switched on, before the actual setting of the setting element can be determined in the controller, the microprocessor is constructed in such a manner that it short-circuits the electric motor independently of the actual setting of the setting element, directly after the hardware initialization routine, by generating a defined switching state of its outputs, associated with the control of the electric motor.

7 Claims, 3 Drawing Sheets

DEVICE AND METHOD FOR CONTROLLING AN ELECTRIC MOTOR, ESPECIALLY IN MOTOR VEHICLES

CROSS-REFERENCE TO RELATED APPLICATIONS

This application is a continuation of PCT International Application No. PCT/EP2005/001569, filed on Feb. 16, 2005, which claims priority under 35 U.S.C. §119 to German Application No. 10 2004 009 307.5, filed Feb. 26, 2004, the entire disclosures of which are expressly incorporated by reference herein.

BACKGROUND AND SUMMARY OF THE INVENTION

The invention relates to a device for controlling an electric motor, especially an electric motor in motor vehicles.

Such a device is known, for example, in connection with a setting element, which can be adjusted by way of the electric motor, for setting a variable valve lift in BMW's Valvetronic® internal combustion engines.

The operating principle of such Valvetronic® internal combustion engines is explained briefly by use of the drawing in FIG. 2. A cam shaft 1, for example the cam shaft assigned to the intake valves, does not directly actuate the valves 2, but rather actuates the valves by way of an intermediate lever 4. An electric motor (for example, the electric motor M in FIG. 1), which is not depicted in FIG. 2, drives a setting element 3 in the form of an eccentric shaft, which acts on the intermediate lever 4 and changes thereby the valve lift of the valves 2. The electric motor is controlled by an electronic controller, e.g., the electronic internal combustion engine controller. At the startup of the controller, a readjustment of the electric motor usually takes place as a function of the deviation of the actual setting from the nominal setting of the setting element 3. The actual setting of the setting element 3 is detected by use of a sensor in the controller.

The object of the invention is to improve upon such a device with respect to the control of the electric motor, when a readjustment is not possible.

The invention meets this and other needs, by use a device for controlling an electric motor, especially in motor vehicles, for setting a setting element, moved by the electric motor, as a function of the deviation of an actual setting from a nominal setting of the setting element by way of a controller, which contains a microprocessor that carries out a hardware initialization routine at least in one step and a software initialization routine optionally in a second step, once the controller has been switched on, before the actual setting of the setting element can be determined in the controller. The microprocessor is constructed such that it short-circuits the electric motor independently of the actual setting of the setting element, immediately after the hardware initialization routine, by generating a defined switching state of its outputs, associated with the control of the electric motor. An advantageous further development of the invention are described and claimed herein.

The invention is based on the recognition that a readjustment is not possible, when the controller has not been put totally into operation, e.g., at reset, or not yet, e.g., shortly after reset or at the start of the switching-on operation during the startup procedure of the internal combustion engine. The reason for this lies in the hardware and software initialization routines that are usually carried out when an intelligent controller, which contains a microprocessor and a program, is put into operation. The full operability of such a controller—said operability usually being a condition for implementing electronic control operations—is not guaranteed until after completion of these initialization routines.

Therefore, according to the invention, the setting element (if it itself is an electric motor) and/or the electric motor, which controls the setting element and is used for slowing down the setting element, is short-circuited—at least as long as a readjustment operation with respect to a specific setting element is not possible, because, for example its actual setting cannot be determined yet. This short-circuiting is done as soon as possible after the controller has been switched on.

The subject of the invention defines the first initialization routine immediately upon switching on the controller, after which the microprocessor may enable its outputs, as the hardware initialization routine. Therefore, the completion of the hardware initialization phase is the earliest time at which at least one control operation of an actuator, such as the electric motor, may be carried out. At this time the electric motor is short-circuited, according to the invention, for the purpose of slowing it down by suitably enabling the outputs of the microprocessor that are necessary for this process. The short-circuiting of the electric motor is preferably the first action that is carried out by the microprocessor in order to prevent an uncontrolled actuation of the electric motor.

Other objects, advantages and novel features of the present invention will become apparent from the following detailed description of the invention when considered in conjunction with the accompanying drawings.

DETAILED DESCRIPTION OF THE DRAWINGS

Figure 1:
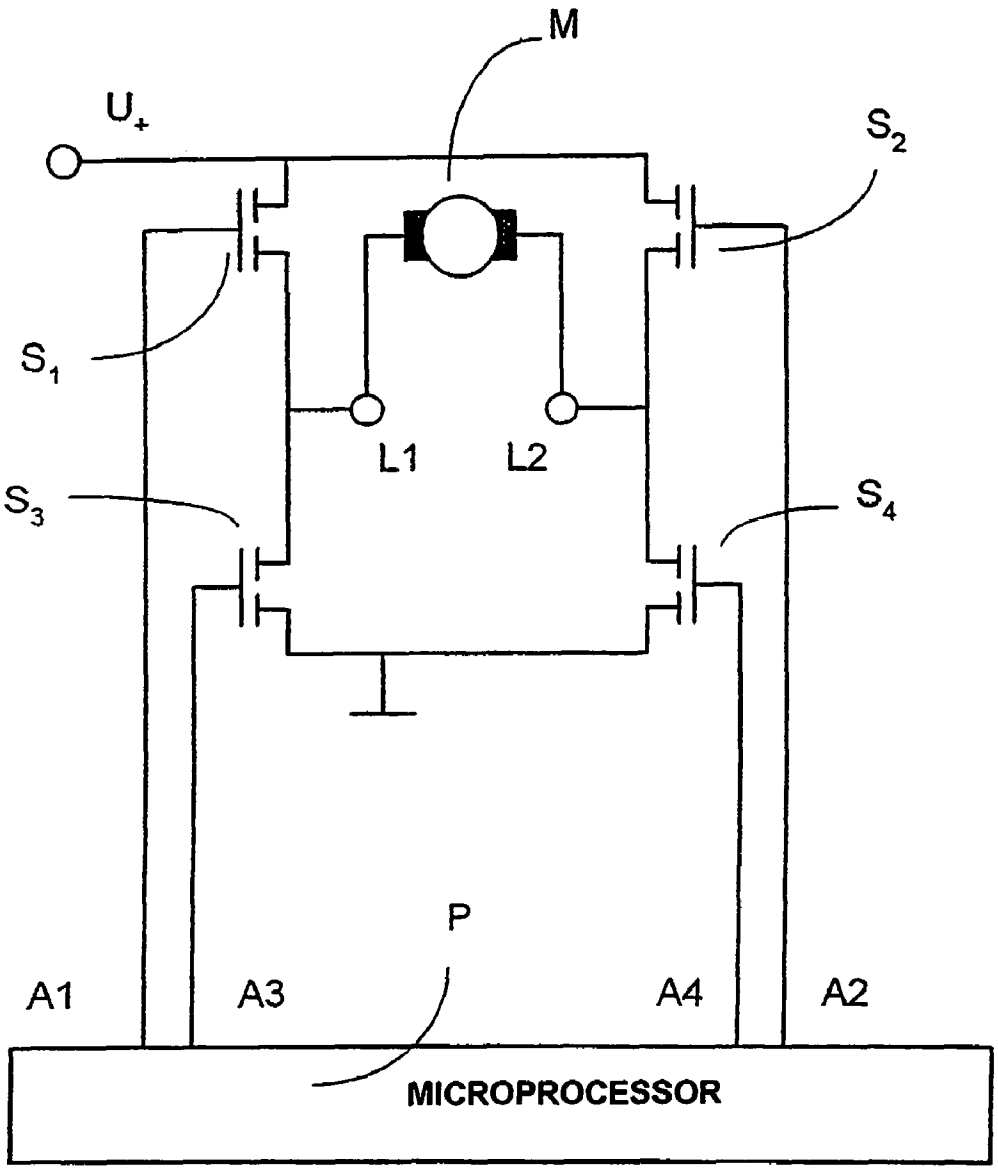
FIG. 1 is a schematic diagram depicting a possible circuit configuration that is especially suitable for carrying out the invention.
Figure 2:
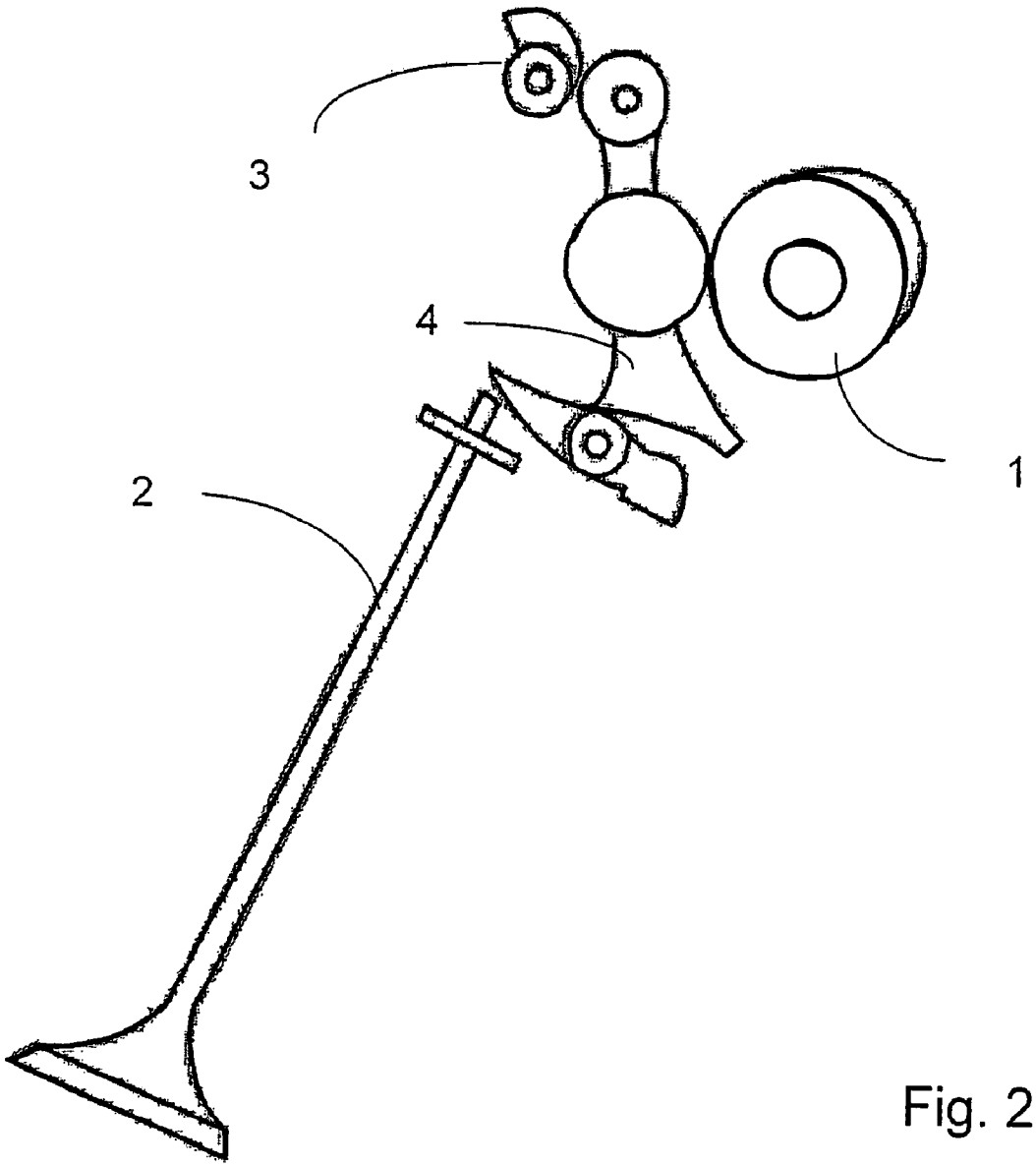
FIG. 2 depicts an especially advantageous valve application for the invention.

FIG. 1 shows an electric motor M, which is controlled by way of a microprocessor P, containing a controller (not illustrated here), via the microprocessor's outputs A1 to A4. Furthermore, the controller contains the electronic switches S1 to S4 (so-called output stages), which can be switched via the switching states to the outputs A1 to A4 of the microprocessor P.

If in a conventional readjustment operation as a function of the actual setting of the setting element, the electric motor M is supposed to rotate in a first direction, the switches S1 and S4 are enabled via the outputs A1 and A4, so that the terminal post L1 of the electric motor M is connected to the positive $U_+$ terminal, and the terminal post L2 of the electric motor M is connected to ground. If the electric motor M is supposed to rotate in a second (in the other) direction, the switches S2 and S3 are enabled via outputs A2 and A3, so that the terminal post L1 of the electric motor M is connected to ground; and the terminal post L2 of the electric motor M is connected to the positive $U_+$ terminal.

Figure 3:
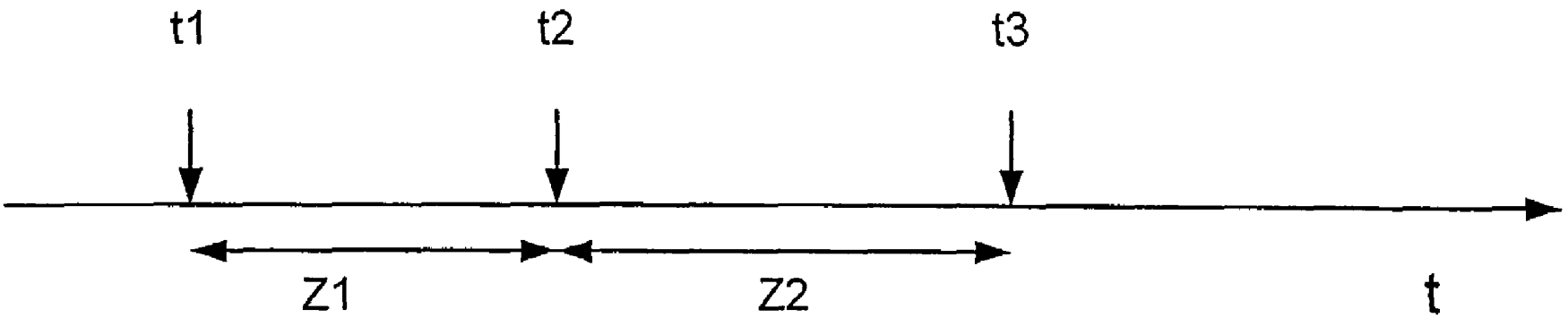
FIG. 3 depicts a time axis with the labeling of the relevant initialization routines for the invention in the controller.

FIG. 3 shows on the time axis t, how in the controller, starting at a time t1, at which, for example, the controller is put into operation again after a reset, first a hardware initialization routine Z1, and then starting at the end of the hardware initialization routine Z1, at the time t2 a software initialization routine Z2 is implemented up to the time t3.

Only after the time t3 is the controller fully operative. However, as early as time t2, the microprocessor may short-circuit the electric motor M, independently of the actual setting of the setting element 3, by generating a defined switching state of its outputs A1 to A4, associated with the control of the electric motor M. To this end, the microprocessor enables preferably the outputs A3 and A4, and thus connects the two terminal posts L1 and L2 of the electric motor M to ground.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A controller for an electric motor in a motor vehicle for setting a setting element as a function of a deviation of an actual setting from a nominal setting of the setting element, the controller comprising:

a microprocessor which, upon being switched-on, performs a hardware initialization routine at least in one step and, optionally, a software initialization routine in a second step, before the actual setting of the setting element is determinable in the controller;

wherein the microprocessor generates a defined switching state of outputs therefrom associated with a control of the electric motor such that the microprocessor operates to short circuit the electric motor independently of the actual setting of the setting element immediately after the hardware initialization routine.

2. The controller according to claim 1, wherein the electric motor has two terminal posts, the microprocessor enabling respective outputs by which the two terminal posts of the electric motor are coupled to ground.

3. A control method for an electric motor in a motor vehicle in which a setting element, moved by the electric motor, as a function of a deviation of an actual setting from a nominal setting of the setting element is controlled, the control method comprising the acts of:

switching-on a controller for the electric motor;

performing a hardware initialization routine of a microprocessor of the controller upon switching-on the controller and before the actual setting of the setting element is determinable in the controller; and operating the microprocessor to short circuit the electric motor independently of the actual setting of the setting element immediately following the hardware initialization routine.

4. The control method according to claim 3, wherein the act of operating the microprocessor to short circuit the electric motor further comprises the act of generating a defined switching state of outputs of the microprocessor associated with a control of the electric motor.

5. The control method according to claim 4, wherein the act of generating a defined switching state further comprises the act of enabling outputs of the microprocessor by which two terminal posts of the electric motor are coupled to ground.

6. A valve control assembly for a motor vehicle, comprising:

an electric motor;

a setting element movable by the electric motor;

a controller having a microprocessor, the controller controlling the electric motor for setting the setting element as a function of a deviation of an actual setting from a nominal setting, wherein the microprocessor, upon switching-on of the controller, carries out a hardware initialization routine at least in one step and a software initialization routine optionally in a second step before the actual setting of the setting element is determinable in the controller; and wherein the microprocessor is operatively configured to short-circuit the electric motor independently of the actual setting of the setting element immediately after the hardware initialization routine by generating a defined switching state of outputs of the microprocessor associated with control of the electric motor.

7. The assembly according to claim 6, wherein the electric motor includes two terminal posts, and wherein the microprocessor enables outputs thereof by which the two terminal posts of the electric motor are coupled to ground.

* * * * *